United States Patent [19]

Bergman

[11] 4,101,419

[45] Jul. 18, 1978

[54] SEPARATOR FOR SEPARATING HIGHER DENSITY METAL VALUES FROM EARTHEN MATERIAL

[76] Inventor: Thomas W. Bergman, R.F.D. Rte. 1, Morgan, Utah 84050

[21] Appl. No.: 695,238

[22] Filed: Jun. 11, 1976

Related U.S. Application Data

[63] Continuation-in-part of Ser. No. 576,734, May 12, 1975, abandoned.

[51] Int. Cl.[2] ..... B03B 5/62

[52] U.S. Cl. ..... 209/13; 209/160

[58] Field of Search ..... 209/13, 18, 155, 158, 209/160, 447, 458–460, 44; 123/20; 224/9, 25 A; 116/117 C

[56] References Cited

U.S. PATENT DOCUMENTS

| | | | |
|---|---|---|---|
| 39,150 | 7/1863 | Joubert | 224/9 |
| 500,662 | 7/1893 | Lockhart | 209/158 |
| 1,031,113 | 7/1912 | Garred | 209/18 |
| 1,193,953 | 8/1916 | Wagner | 209/160 |
| 1,209,771 | 12/1916 | Skancke | 224/9 |
| 1,667,783 | 5/1928 | Harkort | 209/160 |
| 1,917,156 | 7/1933 | Rauschenbusch | 209/18 |
| 2,172,792 | 9/1939 | Mall | 209/18 |
| 2,418,821 | 4/1947 | Coghill | 209/158 |
| 3,799,415 | 3/1974 | Tidd | 224/25 A |
| 3,923,217 | 12/1975 | Dean | 224/25 A X |

FOREIGN PATENT DOCUMENTS

| | | | |
|---|---|---|---|
| 9,193 of | 1911 | United Kingdom | 209/155 |
| 11,664 of | 1896 | United Kingdom | 209/160 |

*Primary Examiner*—Robert Halper

*Attorney, Agent, or Firm*—H. Ross Workman; J. Winslow Young

[57] ABSTRACT

A separator for separating higher density metal values such as particles of gold from a mixture of gold particles and earthen material. The separator includes an upwardly divergent hollow cone and a hollow, transparent column, the transparent column being attached in fluid communication to the apex of the cone. A controllable water supply is connected to diffuser means in the apparatus to diffuse water upwardly through the column and the cone to carry away lighter earthen material in the cone. The water flow rate is adjusted so that the heavier gold particles settle downwardly into the transparent column. The transparent column permits the operator to observe the process and selectively adjust the water flow rate. A screen device may be included for controlling the particle size of material introduced into the separator cone. The separator cone and supporting apparatus therefor may be rendered readily man-portable by being incorporated into a backpack.

10 Claims, 4 Drawing Figures

SEPARATOR FOR SEPARATING HIGHER DENSITY METAL VALUES FROM EARTHEN MATERIAL

BACKGROUND

Related Application

This is a continuation-in-part of my copending application Ser. No. 576,734 filed May 12, 1975, now abandoned.

Field of the Invention

The present invention relates to an elutriator or separator for separating higher density metal values from earthen material by washing away the earthen material while visually observing and controlling the operation.

The Prior Art

Various metallic values are found in elemental form in nature and include, for example, copper, gold, platinum silver and tin. Conventionally, metallic values such as gold and platinum occur in the form of nuggets, and, more commonly, as fine particles referred to as "dust". These fine particles are usually thoroughly dispersed throughout the surrounding earthen material.

The foregoing metal values are known to have densities which are significantly higher than the densities of the surrounding earthen material. For example, these densities range from a low of about 8.3 grams/cc for copper to a high of about 21.4 grams/cc for platinum. Gold has a density of about 19.3 grams/cc.

Particles of earthen material have a density which varies between about 1.8 grams/cc for clay to about 3.3 grams/cc for slate. Commonly, however, particles of earthen material include such materials as agate, dolomite, feldspar, flint, granite, limestone and sandstone, all of which have a density within the range of about 2.14 to about 2.84 grams/cc. Therefore, a particle of gold is approximately 5 to 7 times heavier than a comparable size particle of the conventional surrounding earthen matrix material. As a result, any fluid process which at least partially suspends the metal values and earthen material mixture will tend to allow the heavier particles to settle. The heavier metal values thereby become somewhat concentrated in deposits. Geologically, these deposits are commonly referred to as placer deposits and occur as a result of normal geological processes such as glaciation, weathering, erosion, and the like. Accordingly, placer deposits will generally be found adjacent present and ancient stream beds.

Historically, man has known of this natural phenomena and has, advantageously, utilized this knowledge and the difference in density for the purpose of locating and separating the metallic values from the earthen material.

Numerous refinements of this separation technique have been developed and also patented for the purpose of improving the extraction of gold particles from the surrounding earthen material. Known patents include, for example, U.S. Pat. Nos. 489,538; 636,675; 907,387; 1,193,958; and 3,550,773; and British Pat. Nos. 171,266 and 211,680.

It would, however be an improvement over the prior art to provide a separator apparatus and method whereby a relatively large quantity of earthen material may be readily classified with the operator being able to visually observe and thereby control the functioning of the apparatus. It would also be an improvement in the art to provide a separator apparatus which is readily adapted to be man-portable by being incorporated into a backpack. Such an apparatus and method is disclosed herein.

BRIEF SUMMARY AND OBJECTS OF THE INVENTION

The present invention relates to a separator, elutriator, or classifier wherein water is directed upwardly into an upwardly divergent cone so as to suspend and carry away lighter earthen material deposited therein. Heavier particles of metallic values are allowed to fall downwardly toward the apex of the cone and into a downwardly depending hollow, transparent column in fluid communication with the cone. The transparent column permits visual observation of the separation operation by the operator. The operator is thus able to selectively adjust the countercurrent water flow to allow the heavier particles to metallic values to fall downwardly into the column where they are collected and recovered. The separator apparatus may be readily adapted to be man-portable by being readily disassembled and incorporated into a backpack.

It is, therefore, a primary object of this invention to provide improvements in the method for separating higher density metal values from surrounding earthen material.

Another object of this invention is to provide an improved apparatus for separating higher density metal values from surrounding earthen material.

An even still further object of this invention is to provide a man-portable separator for separating metallic values from surrounding earthen material wherein the separator is readily incorporated into a backpack so as to be man-portable from place to place.

An even still further object of this invention is to provide a separator wherein the final separation of metallic values from earthen material is accomplished in a transparent column which permits visual observation of the separation process thereby accommodating selective adjustment of the separation process.

These and other objects and features of the present invention will become more fully apparent from the following description and appended claims taken in conjunction with the accompanying drawing.

DETAILED DESCRIPTION OF THE PREFERRED EMBODIMENTS

Figure 1:
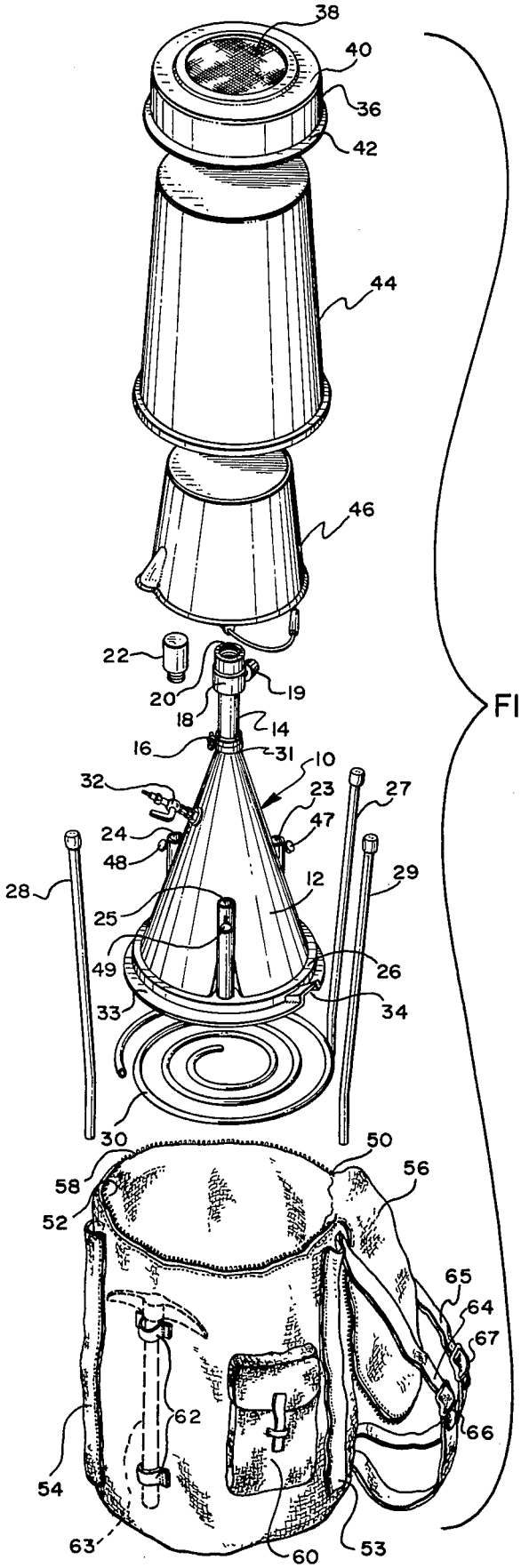
FIG. 1 is an exploded perspective view of the disassembled apparatus of one presently preferred embodiment of this invention illustrating the interrelationship of the various components as they assemble into a backpack.

The invention is best understood by reference to the drawing wherein like parts are designated with like numerals throughout.

Figure 2:
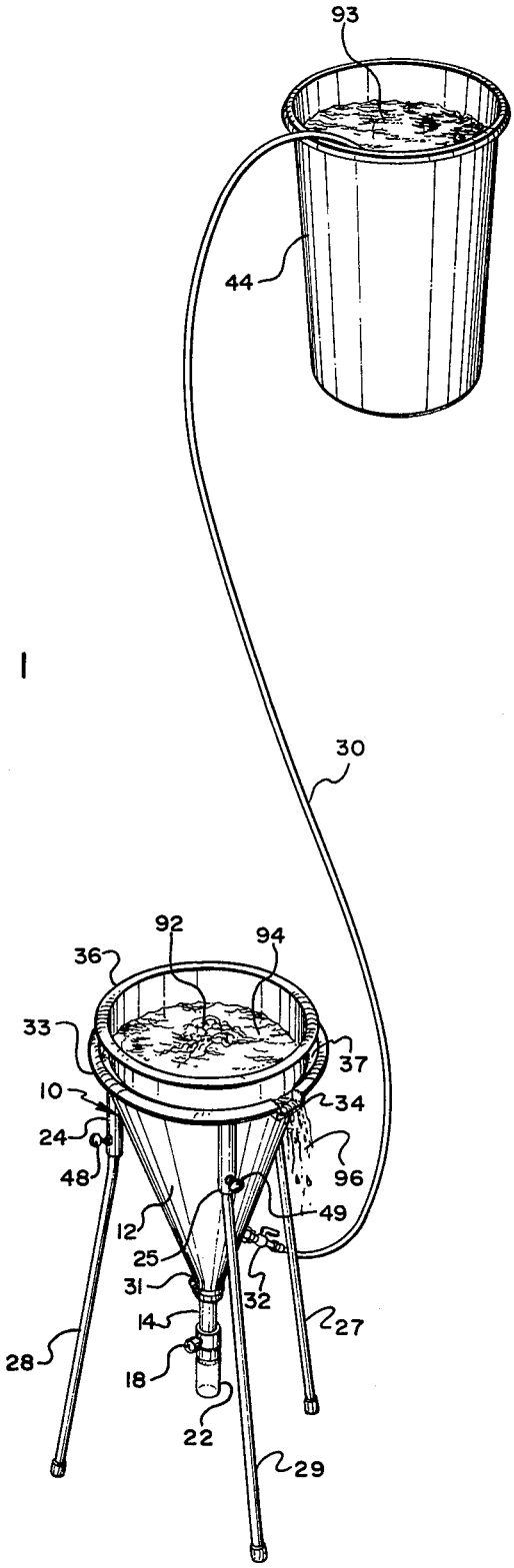
FIG. 2 is a perspective view of the embodiment of FIG. 1 in its assembled, operative configuration.

Referring now to FIGS. 1 and 2, the separator cone is shown generally at 10 and includes a conical surface or cone 12 which is oriented to taper from a rim 33 to an apex 31. A hollow, transparent column 14 is clamped to apex 31 in fluid communication with cone 12 by a clamp 16. Transparent column 14 serves as an observation tube or sight glass as will be discussed more fully hereinafter.

Figure 3:
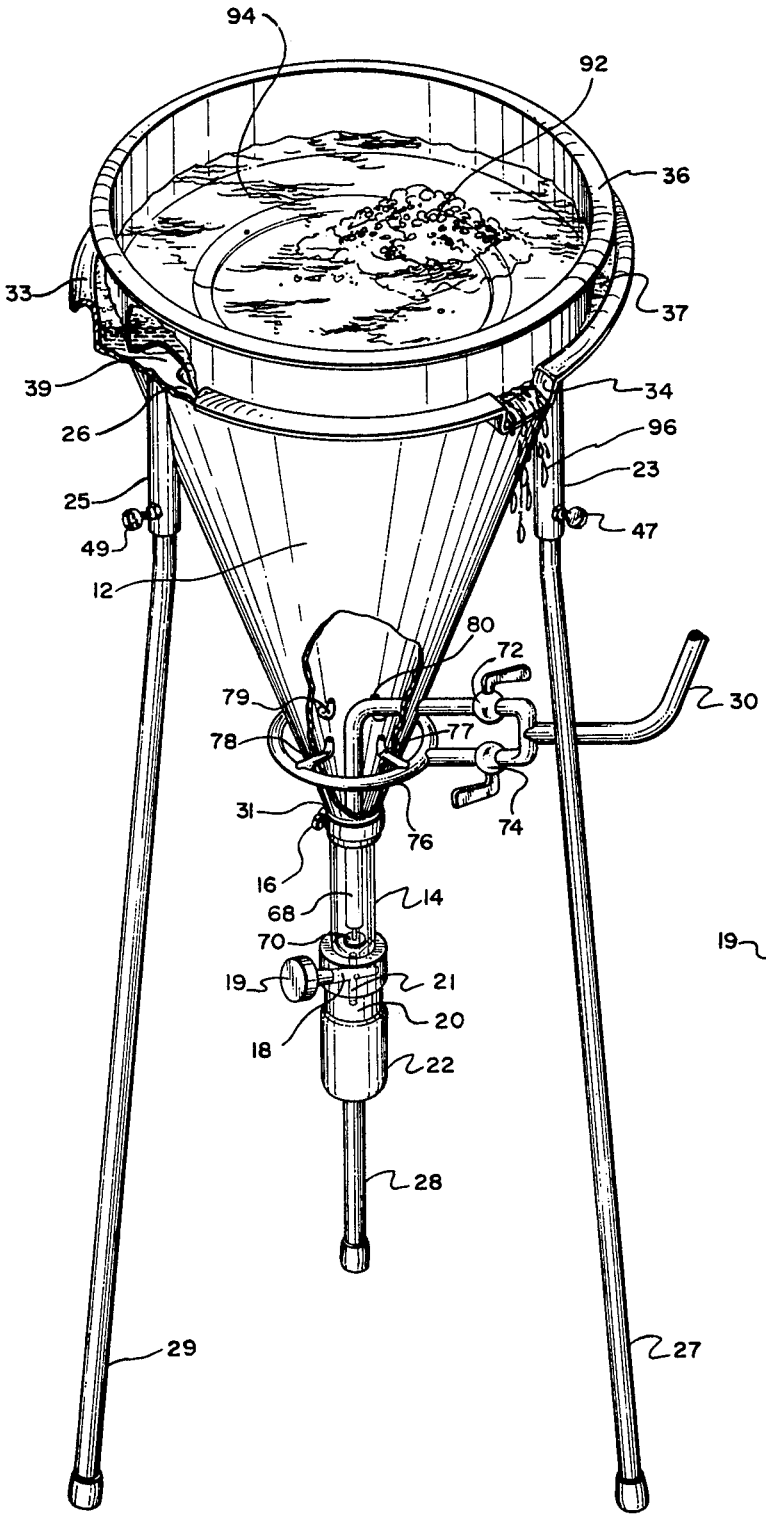
FIG. 3 is a perspective view of a second preferred embodiment of the present invention with parts broken away to reveal internal components.

Experimentally, it has been determined that a cone having an angle of divergence of between 30° and 44° appears to exhibit the most desirable separation characteristics. Cone 12 includes a plurality of leg sockets 23–25 which are adapted to receive a plurality of legs 27–29 with each leg being adjustably and releasably secured therein by set screws 47–49, respectively. Each of legs 27–29 are adjustable within their respective leg sockets by means of set screws 47–49 so as to permit the operator (not shown) to suitably level the separator cone 10 as indicated schematically in FIG. 2. Each of leg sockets 23–25 terminate at an internal shelf 26 of cone 12 to form an inwardly extending platform 39 (FIG. 3).

Platform 39 serves as a support surface for a screen pan 36 as will be discussed more fully hereinafter. Screen pan 36 is configurated as an open-top pan having a bottom 40 and a screen 38 interposed in a portion of bottom 40. Bottom 40 is configurated to include an annular surface surrounding screen 38 to provide a nonpervious surface which may be selectively used in a manner similar to a gold pan for the purpose of concentrating and further examining metallic values obtained by the separator cone 10. Screen pan 36 includes a rim 42 which accommodates hand grasping of screen pan 36 for ease of handling. Screen pan 36 is diametrally reduced from the internal diameter of rim 33 so as to provide a gap 37 between screen pan 36 and rim 33. Gap 37 permits the overflow of water and debris 96 through an overflow 34.

Overflow 34 is provided in rim 33 of cone 12 to direct the overflow as a stream of water and earthen debris 96 to a predetermined location so as not to interfere with the operation of valves 18 and 32 and visual observation through transparent column 14 as will be discussed further. Importantly, overflow 34 is situated above platforms 39 so as to provide an incremental level of water over platforms 39 thereby permitting inundation of screen 38 when screen pan 36 is placed in the open mouth of cone 12. In this manner, water 94 infiltrates screen pan 36 through screen 38 to assist in washing earthen material 92 placed therein. Water 94 loosens particles of metallic values and permits them to escape downwardly through screen 38 along with similar-sized earthen particles to there be further separated as will be discussed more fully hereinafter with respect to the functioning of separator cone 10.

A valve 32 is affixed to the exterior of cone 12 and provides for the selective control of water diffused upwardly into the interior of cone separator 10 by means of either a downwardly-extending, coaxial diffuser tube 68 (FIG. 3) or an upwardly-extending, coaxial diffuser tube 83 (FIG. 4) as will be discussed more fully hereinafter with respect to FIGS. 3 and 4 and to the operation of separator cone 10.

Transparent column 14 is configurated as a hollow column and has a diffuser tube 68 and diffuser 70 (FIG. 3) coaxially disposed therein. The diffuser tube 68 is used to introduce water into transparent column 14 while diffuser 70 diffuses the water evenly so as to reduce turbulence and regions of high flow velocity which would disrupt the separation process, as discussed more fully hereinafter.

Transparent column 14 is closed at its lower end by a valve 18 which is configurated as a flow-through valve so as to allow particles of metal values to fall therethrough. A collection bottle 22 is releasably attached to the base of valve 18 by means of screw cap 20 and is in fluid communication therewith. The internal functioning of valve 18 and its relationship to collection bottle 22 will be discussed more fully hereinafter with respect to the embodiment illustrated in FIG. 4.

Included within the apparatus of separator cone 10 is a reservoir 44 for water 93 and which is connected in fluid communication to valve 32 by means of tubing 30. In one presently preferred embodiment of this invention, reservoir 44 is configurated to receive approximately 7–8 gallons (26.5–30.3 liters) of water and may be placed an incremental distance above separator cone 10 so as to provide a sufficient hydraulic head to water 93 therein. A bucket 46 is selectively included with the apparatus for the purpose of permitting the operator (not shown) to fill reservoir 44 with water 93 when reservoir 44 has been suitably situated.

In one presently preferred embodiment of this invention, separator cone 10 and the supporting apparatus therefor is conveniently made man-portable by providing for partial disassembly and nesting of the various components in a backpack 50. Backpack 50 is configurated as a closed cylinder of fabric material having a top 56 closable by a zipper 58. Backpack 50 includes three elongated pockets, two of which are shown herein as pockets 53 and 54, which telescopically receive legs 27–29. Conveniently, each of legs 27 and 29 are received in their respective pockets and function in cooperation with shoulder straps 64 and 65 so as to contribute to backpack 50 in the form of a pack frame.

Backpack 50 is rendered easily man-portable by shoulder straps 64 and 65 which include adjustment buckles 66 and 67, respectively, so as to adapt backpack 50 to the individual preference of the operator (not shown) carrying backpack 50. Additionally, backpack 50 may incorporate a number of accessory features such as tool loops 62 which may, selectively, receive a geologist's pick 63 shown herein in broken lines. Additionally, tool loops 62 may also receive a small shovel, trenching tool or the like. Furthermore, as a convenience, backpack 50 may also include an accessory pocket 60. These numerous features are readily available in various backpack arrangements and are discussed herein for the purpose of demonstrating the utility of backpack 50.

As an additional feature, internal surface 52 of backpack 50 may be selectively waterproofed or provided with a suitable waterproof lining so as to permit the use of backpack 50 as a water reservoir 44 thereby eliminating the separate reservoir 44. Backpack 50 would thereby provide the additional feature of being suspendable from a tree or the like (not shown) by means of shoulder straps 64 and 65 on those occasions where it is warranted. In this manner, backpack 50 would completely obviate the need for a second water reservoir 44; however, for ease of presentation herein, the discussion will relate to a separate water reservoir 44 acting as a reservoir for water 93.

Referring now more particularly to FIG. 3, a second presently preferred embodiment of the invention is illustrated wherein a plurality of jets 77–80 are provided in the lower end of cone 12 for the purpose of introducing additional quantities of water into cone 12 in addition to that water introduced through diffuser tube 68.

Jets 77–80 are arrayed radially around the axis of cone 12 adjacent apex 31 with each jet being directed upwardly and approximately parallel to the axis of cone 12. A header 76 externally encircles cone 12 and is in fluid communication with jets 77–80. A valve 74 selectively controls the volumn of water admitted into a header 76.

Valve 72 permits selective control of water introduced into diffuser tube 68. Water from diffuser tube 68 is diffused outwardly against the inside walls of transparent column 14 by a diffuser 70 which is interposed in the flow path of water exiting diffuser tube 68. In this manner, the water entering through diffuser tube 68 is smoothly and evenly diffused throughout transparent column 14 so as to provide an improved final separation and removal of the lighter earthen materials from the downwardly-falling, heavier metallic values (not shown). In particular, the even diffusion of water reduces the tendency for the upwardly flowing water to create zones of high velocity and/or lift which would interfere with the downward fall of smaller, lighter particles of metal values.

The water, shown herein as water 94, flows upwardly from diffuser tube 68 and, selectively, jets 77–80, into the body of separator cone 12 where it intimately contacts and removes earthen material from downwardly-falling particles of metallic values. Additionally, water 94 flows upwardly through screen 38 of screen pan 36 and thereby washes earthen material 92 in screen pan 36. The water with suspended earthen material overflows from separator cone 12 through overflow 34 as water and earthen debris stream 96 where it is thereafter discarded.

The principal difference between the illustrated embodiment of FIG. 3 and that of FIGS. 1 and 2 is that the embodiment illustrated in FIGS. 1 and 2 does not include a second valve 74, header 76 and jets 77–80. Instead, the embodiment of FIGS. 1 and 2 utilizes only the diffuser tube 68 in the transparent column 14.

Figure 4:
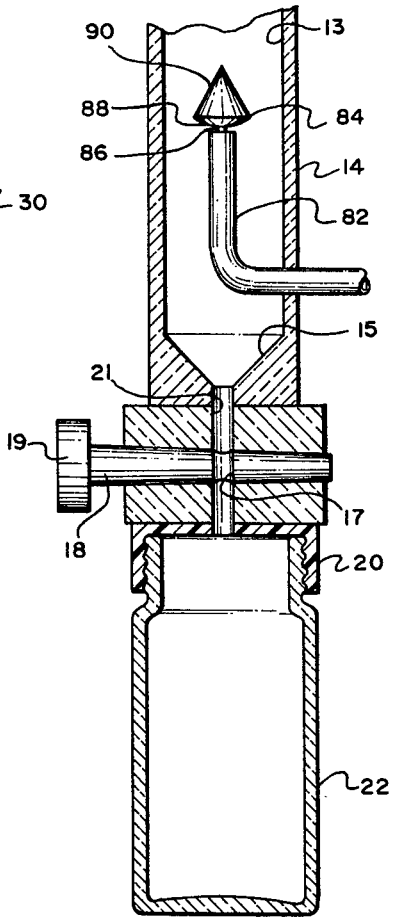
FIG. 4 is a fragmentary cross section of another preferred embodiment of a portion of the invention.

Referring now to FIG. 4, a second preferred embodiment of the diffuser in transparent column 14 is illustrated and includes a coaxial, upwardly-directed diffuser tube 82 and a diffuser 84 against which the incoming water impinges and is diffused outwardly against internal wall 13 of transparent column 14. Diffuser tube 82 is in direct fluid communication with a reservoir of water through a valve (not shown) which is comparable to either of valve 72 (FIG. 3) or valve 32 (FIGS. 1–2). Diffuser 84 is mounted on a coaxial stem 86 and presents a spherical surface 88 against which the water impinges. The opposite face of diffuser 84 is a conical surface 90 which acts as a deflector for metallic values (not shown) falling downwardly in transparent column 14 to deflect the same from falling into diffuser tube 82.

The lower end of transparent column 14 terminates in a conical surface 15 which directs metallic values therein toward outlet 21. Outlet 21 is selectively closed and opened by means of valve 18 having a bore 17 therethrough. Valve 18 is rotatable by means of knob 19 to permit the selective alignment of bore 17 with outlet 21 to provide direct fluid communication between transparent column 14 and a collection bottle 22 attached to screw cap 20. Advantageously, collection bottle 22 is filled with water prior to attachment to screw cap 20 so that there is no air which will bubble upwardly through outlet 21 into transparent column 14 when valve 18 is opened. In this manner, valve 18 may be opened to collect the metal values from the interior of transparent column 14. The metal values are directed downwardly through outlet 21 and into collection bottle 22 thereby displacing only water upwardly into transparent column 14. In this manner, the continued operation of separator cone 10 is not adversely affected by the selective removal of portions of the collected metallic values in transparent column 14.

The Method

As illustrated, separator cone 10 and the accompanying apparatus of backpack 50, reservoir 44 and bucket 46 are readily rendered man-portable. However, the same operational features with respect to the internal functioning of separator cone 10 may be incorporated in a larger unit which is not man-portable but requires appropriate vehicular equipment for transportation. In either event, the same basic functional features are provided as has been discussed previously and as will be discussed more fully hereinafter. However, the further discussion herein will be directed to the man-portable embodiment.

To use separator cone 10 of this invention, the operator (not shown) selectively transports backpack 50 and the enclosed equipment therein including separator cone 10, bucket 46, tubing 30, and reservoir 44 to a preselected location. Thereafter, zipper 58 is unzipped and the equipment in backpack 50 removed. Separator cone 10 is assembled by placing each of legs 27–29 in respective leg sockets 23–25 and the cone 12 leveled by the selective adjustment of legs 27–29 and tightening of set screws 47–49. Collection bottle 22 is filled with water and screwed to screw cap 20. Using bucket 46, the operator (not shown) fills cone 12 with water while valve 32 (FIG. 2) or valves 72 and 74 (FIG. 3) are closed.

Reservoir 44 (or backpack 50, when adapted as a reservoir as set forth hereinbefore) is placed in an elevated location above separator cone 10 and filled with water 93 using bucket 46. In one presently preferred embodiment of the invention, it has been found that an elevation as little as approximately 8 inches (20.32 cm) is sufficient to provide the necessary hydraulic head to water 93 for the efficient operation of separator cone 10.

With each of cone 12 and reservoir 44 filled with water, tubing 30 is connected to valve 32 and valve 32 is opened until water fills tubing 30. The open end of tubing 30 is then closed off and immediately plunged into water 93 of reservoir 44 so that tubing 30 will serve as a syphon for directing water 93 into separator cone 10. Valve 32 may be left open until a quantity of water spills out of overflow 34.

The separation process is commenced by placing a quantity of earthen material to be tested, earthen material 92, in screen pan 36. Screen pan 36 is then partially immersed in water 94 in the open end of cone 12. Screen pan 36 and earthen material 92 are suitably agitated back and forth so that water 94 mixes with and washes earthen material 92 causing the finer particles thereof to fall downwardly through screen 38 into cone 12. In the one presently preferred embodiment of this invention, screen 38 has a size 24 mesh which adapts screen pan 36 very well to the particular embodiment. Clearly, however, other screen mesh sizes may be, advantageously, utilized and would require only the selective adjustment of the rate at which the water is diffused into separator cone 10. It is, of course, understood that the larger sized particles of earthen material will require an increased flow rate of water to accommodate separation. However, an increased water flow rate will also increase the tendency for the water to carry away the smaller particles of metal values. Accordingly, the mesh size of screen 38 should be selected with a view toward the optimum collection of metal values from a preselected location. To this end, additional screen pans 36 may be provided and each include a screen 38 with a different size mesh.

The upwardly-welling water 94 from either of diffusers 68 and 82 and/or jets 77–80 suspends and carries away the lighter, less dense earthen material where it is directed to overflow 34 as a stream of water and debris 96. The flow of upwardly-welling water is selectively adjusted so that it is incapable of suspending metallic values but permits them to fall downwardly through cone 12 into transparent column 14. Importantly, the precise adjustment of valve 32 or valve 72 is obtained by the operator (not shown) visually observing the functioning of separator cone 10 through transparent column 14 and selectively adjusting the appropriate valve until the flow rate therethrough and the desired separation of the metallic values and the earthen material is attained. Once the proper valve setting has been selectively attained, the operator is thereafter free to continually replenish earthen material 92 in screen pan 36 while periodically replenishing water 93 in water reservoir 44. One experimental embodiment of this invention was found to operate for about 32 minutes before it was necessary to refill reservoir 44. In this manner, it is possible for an operator to attain separation of a relatively large quantity of earthen material 92 without the necessity for continually readjusting the functioning of separator cone 10.

Additionally, periodic removal of metallic values from transparent column 14 is readily attained by opening valve 18 to permit the metallic values to fall downwardly through outlet 21 into collection bottle 22. As set forth hereinbefore, the operation of the apparatus of transparent column 14 and the diffuser therein is not disturbed by an air bubble or the like since collection bottle 22 is initially filled with water prior to being attached to screw cap 20. Transparent column 14, therefore, not only readily accommodates the visual observation and adjustment of the operation of separator cone 10 but also permits the visual ascertainment of when a sufficient quantity of metallic values have been collected therein so that they may be periodically removed without disturbing the continued functioning of separator cone 10.

Clearly, the foregoing features of the apparatus and method of this invention can be readily accommodated to a larger unit which is not man-portable but requires vehicular transportation. In either event, the operator (not shown) is able to visually observe the functioning of separator cone 10 through transparent column 14 and thereby selectively adjust the flow rate of the water diffused therein.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A man-portable separator for separating higher density metal values from lower density earthen materials comprising:

a separator cone comprising a right circular conical surface adapted to be placed with its axis in a generally vertical orientation and upwardly divergent with a downward apex;

a transparent, tubular column attached to the apex and in fluid communication with the cone;

a diffuser means for introducing a controlled flow of water into the column and the cone from adjacent the bottom of the column;

a transparent collection reservoir releasably secured to the lower end of the column below the diffuser means for receiving higher density metal values;

adjustable leg means removably attached to the cone for supporting the cone and the column above the ground;

a water reservoir means adapted to be removably interconnected to the diffuser means and supported an incremental distance above the diffuser means and cone; and a flat-bottom container dimensionally configurated to be received in an upper portion of the cone, the container having a screen member interposed in a portion of the bottom surface of the container.

2. A man-portable separator for separating higher density metal values from lower density earthen materials comprising:

a separator cone comprising a right circular conical surface adapted to be placed with its axis in a generally vertical orientation and upwardly divergent with a downward apex;

a transparent, tubular column attached to the apex and in fluid communication with the cone;

a diffuser means for introducing a controlled flow of water into the column and the cone;

adjustable leg means removably attached to the cone for supporting the cone and the column above the ground;

a water reservoir means adapted to be removably interconnected to the diffuser means and supported an incremental distance above the diffuser means and cone;

a container dimensionally configurated to be received in an upper portion of the cone, the container having a screen member interposed in a portion of the bottom surface of the container; and socket means molded into the wall of the cone for exteriorly receiving the leg means and interiorly serving as a support for the container.

3. A separator as defined in claim 2 wherein the cone includes an overflow adjacent the upper end of the cone and the container is dimensionally configurated to be received in the cone so that the screen is below the level of the overflow.

4. A separator as defined in claim 2 wherein the column includes a valve means at the lower end and a receptacle removably mounted to the valve means, the valve means accommodating communication between the column and the receptacle.

5. A separator as defined in claim 2 wherein the diffuser comprises a hollow tube coaxial with a portion of the column and having a distributor at the end of the tube to spread the water uniformly toward the wall of the column.

6. A separator as defined in claim 2 wherein the cone is dimensionally configurated to be received in the water reservoir means for compactness in transporting the separator.

7. A separator as defined in claim 2 wherein the separator is dimensionally configurated to be received in a backpack for rendering the separator man-portable from place to place.

8. A separator as defined in claim 7 wherein the backpack is fabricated with a suitable waterproof lining so as to adapt the backpack as the reservoir means.

9. A method for separating higher density metal values from lower density earthen materials comprising the steps of:

preparing a separator cone as a right conical surface and orienting the axis of the cone vertically with the cone being divergent upwardly;

attaching a transparent, hollow, cylindrical column to the apex of the cone so that the column is in fluid communication with the interior of the cone;

introducing water into the column and cone by diffusing at least a portion of the water into the column adjacent the lower end of the column;

screening a quantity of earthen material containing higher density metal values into the cone, the screen admitting only particles of a predetermined size into the cone;

visually observing the flow of particles into the column while regulating the flow of water diffusing into the column thereby separating higher density metal values from lower density earthen materials by forcing the lower density earthen materials upwardly in the cone with the water while allowing higher density metal values to fall downwardly into the column;

attaching a water-filled collection reservoir to the lower end of the transparent column in fluid communication with the column;

interposing a valve means between the column and the collection reservoir; and removing metal values from the column without disturbing the operation of the column by visually observing when the metal values have accumulated in the bottom of the column and opening the valve means thereby permitting the metal values to fall into the collection reservoir upwardly displacing water therein.

10. A method for determining if earthen material at spaced locations contains metal values comprising the steps of:

preparing a separator apparatus by obtaining a hollow cone and attaching a transparent column to the apex of the cone in fluid communication with the cone;

forming a portion of a backpack as a water reservoir for the separator apparatus;

incorporating the separator apparatus into the backpack so as to be man-portable from place to place;

transporting the separator from place to place to a preselected location to be tested for metal values;

setting up the separator at each location with the axis of the cone vertical, the cone being upwardly divergent;

filling the reservoir with water and interconnecting the reservoir with the separator;

diffusing water upwardly through the transparent column into the cone;

separating metal values from earthen material by placing a quantity of earthen material in the cone and washing away the earthen material while allowing the metal values to fall downwardly into the transparent column; and observing the separating step through the transparent column and selectively adjusting the water flow rate to control the separating step.

* * * * *